US007679521B1

(12) United States Patent
Gavia et al.

(10) Patent No.: US 7,679,521 B1
(45) Date of Patent: Mar. 16, 2010

(54) CHRISTMAS TREE ORNAMENT WITH INTEGRATED SMOKE DETECTOR, HEAT DETECTOR, MOTION SENSOR, AND FIRE EXTINGUISHING MEANS

(76) Inventors: Cesar Gavia, 5412 Athens Cir., La Palma, CA (US) 90623; Jeff Davis, 5412 Athens Cir., La Palma, CA (US) 90623

( * ) Notice: Subject to any disclaimer, the term of this patent is extended or adjusted under 35 U.S.C. 154(b) by 253 days.

(21) Appl. No.: 11/799,475

(22) Filed: May 1, 2007

(51) Int. Cl.
*G08B 17/10* (2006.01)

(52) U.S. Cl. ..... 340/628; 340/632; 340/693.6; 169/13; 169/60; 169/61; 169/46

(58) Field of Classification Search ..... 340/628, 340/693.5, 693.6, 539, 629, 639.2; 362/567, 362/276; 169/56, 61, 13, 11, 54, 58, 60, 169/46

See application file for complete search history.

(56) References Cited

U.S. PATENT DOCUMENTS

| | | | | | |
|---|---|---|---|---|---|
| 3,783,946 | A * | 1/1974 | Petrinec et al. | 169/61 |
| D244,362 | S | 5/1977 | Mayer | |
| 4,075,614 | A * | 2/1978 | White | 340/594 |
| 4,623,878 | A * | 11/1986 | Schoenwetter | 340/628 |
| 5,018,586 | A * | 5/1991 | Cawley et al. | 169/56 |
| 5,031,702 | A * | 7/1991 | Trumbach | 169/61 |
| D352,366 | S * | 11/1994 | Cox | D29/125 |
| 5,396,221 | A * | 3/1995 | Bridges | 340/628 |
| 5,625,345 | A * | 4/1997 | Stark et al. | 340/628 |
| 5,821,865 | A * | 10/1998 | Solak | 340/628 |
| 5,880,676 | A * | 3/1999 | Tsou | 340/628 |
| 6,003,610 | A * | 12/1999 | Kordes | 169/61 |
| 6,021,852 | A * | 2/2000 | Barnett et al. | 169/58 |
| 6,075,447 | A * | 6/2000 | Nightingale et al. | 340/628 |
| 6,088,960 | A * | 7/2000 | Hartzog | 47/65.5 |
| 6,244,353 | B1 * | 6/2001 | Greer | 169/61 |
| 6,382,582 | B1 * | 5/2002 | Brown | 248/521 |
| 6,384,732 | B1 | 5/2002 | Schumer | |
| 7,247,076 | B2 * | 7/2007 | Dang et al. | 446/102 |
| 7,248,230 | B2 * | 7/2007 | Piccionelli | 345/2.1 |
| 7,443,307 | B1 * | 10/2008 | Porpora | 340/628 |
| 2002/0126506 | A1 * | 9/2002 | Syme | 362/567 |
| 2004/0085258 | A1 * | 5/2004 | Piccionelli | 345/2.1 |
| 2004/0124987 | A1 * | 7/2004 | Moretz | 340/604 |
| 2005/0195088 | A1 * | 9/2005 | Solak | 340/628 |
| 2007/0086755 | A1 * | 4/2007 | Dang et al. | 388/804 |
| 2007/0137075 | A1 * | 6/2007 | Dang et al. | 40/431 |
| 2007/0236409 | A1 * | 10/2007 | Piccionelli | 345/2.1 |
| 2008/0055098 | A1 * | 3/2008 | Toland | 340/628 |

OTHER PUBLICATIONS

WORLDCLASSCHRISTMAS.COM, Christmas Tree Electronic Fire Alarm, 2005-2006 Holiday Season.

* cited by examiner

*Primary Examiner*—Davetta W Goins
*Assistant Examiner*—Hoi C Lau

(57) ABSTRACT

The invention is a Christmas tree ornament that incorporates a smoke or fire detector, a burglar alarm operated by a motion sensor, and connects to an integrated fire extinguishing system. The Christmas tree ornament resembles a star, but can also be designed to reflect an angel, or any other Christmas tree decoration that typically rests on top of the Christmas tree. A fire extinguishing system connects to the ornament and runs the length of the tree to the fire extinguishing fluid reservoir that is located in a unit that rests on the floor. The invention is powered by an electrical cord as well as a battery backup. A speaker is integrated into the device, and features the same high sound level capability of traditional smoke detectors.

4 Claims, 3 Drawing Sheets

CHRISTMAS TREE ORNAMENT WITH INTEGRATED SMOKE DETECTOR, HEAT DETECTOR, MOTION SENSOR, AND FIRE EXTINGUISHING MEANS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of Christmas tree ornaments that double as smoke detectors, more particularly multi-purpose Christmas tree stars.

A Christmas tree, though very festive, is a great fire hazard for the home. That being said, there has been a need to provide fire detection devices in and around the tree to alert the residents of a potential fire should something go awry. Furthermore, should a fire start on a Christmas tree, there may be no one around to extinguish the fire in time, so a fire prevention means is also a desirable aspect to incorporate into a Christmas tree ornament.

The holiday season also brings about opportunity for a rise in burglaries, especially of presents resting underneath a Christmas tree. That being said, a Christmas tree star that can double as a burglar alarm for bodily movement in and around the tree would be another desired feature.

B. Discussion of the Prior Art

The Schumer Patent (U.S. Pat. No. 6,384,732) discloses a smoke detector that is easily attached to the limb of a Christmas tree that includes a smoke detector circuit, and an audible alarm circuit for generating an audible alarm in response to the detection of smoke. However, this patent does not disclose a fire prevention system that is integrated into the invention, nor does it include an integrated burglar alarm.

The Solak Patent (U.S. Pat. No. 5,821,865) discloses a smoke/heat detector in the form of a Christmas tree ornament which utilizes a spherical ornament housing divided by a fire-resistant barrier into lower and upper chambers. However, this patent does not disclose a device that incorporates a fire prevention system into the invention, nor does it disclose a burglar alarm.

The Stark et al. Patent (U.S. Pat. No. 5,625,345) discloses a fire safety apparatus particularly useful in association with Christmas trees comprising a smoke detector, circuitry for processing a signal generated by the smoke detector, an audible alarm, a moisture level sensor, and circuitry for interruption of the flow of electricity to a receptacle. However, this patent does not disclose a fire prevention system, nor does it disclose a burglar alarm.

The Bridges Patent (U.S. Pat. No. 5,396,221) discloses a smoke alarm disguised as a Christmas tree ornament. As mentioned above, this patent does not disclose an ornament with a burglar alarm and an integrated fire extinguishing system.

The Schoenwetter Patent (U.S. Pat. No. 4,623,878) discloses a smoke alarm mounted atop a Christmas tree, where an early indication of an impending fire may be generated. However, the smoke alarm detector is not integrated into a star, and nor does it provide burglar alarm and fire extinguishing capabilities.

The Mayer Patent (U.S. Pat. No. Des. 244,362) illustrates a design for a fire detector.

A non-patent prior art document includes a Christmas Tree Electronic Fire Alarm that discloses a smoke and fire detector contained within a Christmas tree ornament. However, the device does not provide a burglar alarm nor does it provide fire extinguishing means.

BRIEF SPRY OF THE INVENTION

The invention is a Christmas tree ornament that incorporates a smoke or fire detector, a burglar alarm operated by a motion sensor, and connects to an integrated fire extinguishing system. The Christmas tree ornament resembles a star, but can also be designed to reflect an angel, or any other Christmas tree decoration that typically rests on top of the Christmas tree. A fire extinguishing system connects to the ornament and runs the length of the tree to the fire extinguishing fluid reservoir that is located in a unit that rests on the floor. The invention is powered by an electrical cord and battery backup. A speaker is integrated into the device, and features the same high sound level capability of traditional smoke detectors.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 2:
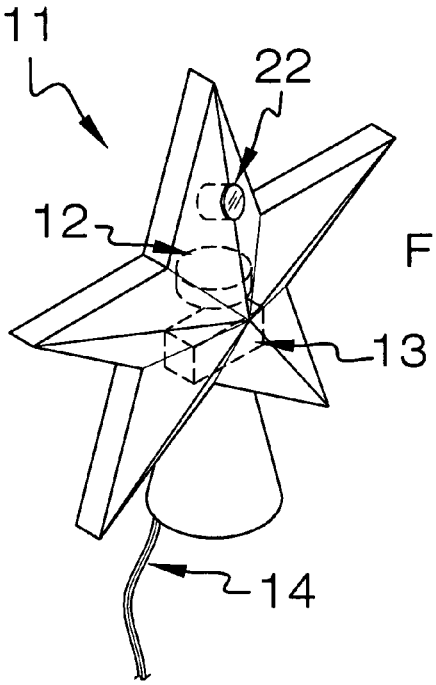
FIG. 2 illustrates a front view of the invention in use.
Figure 1:
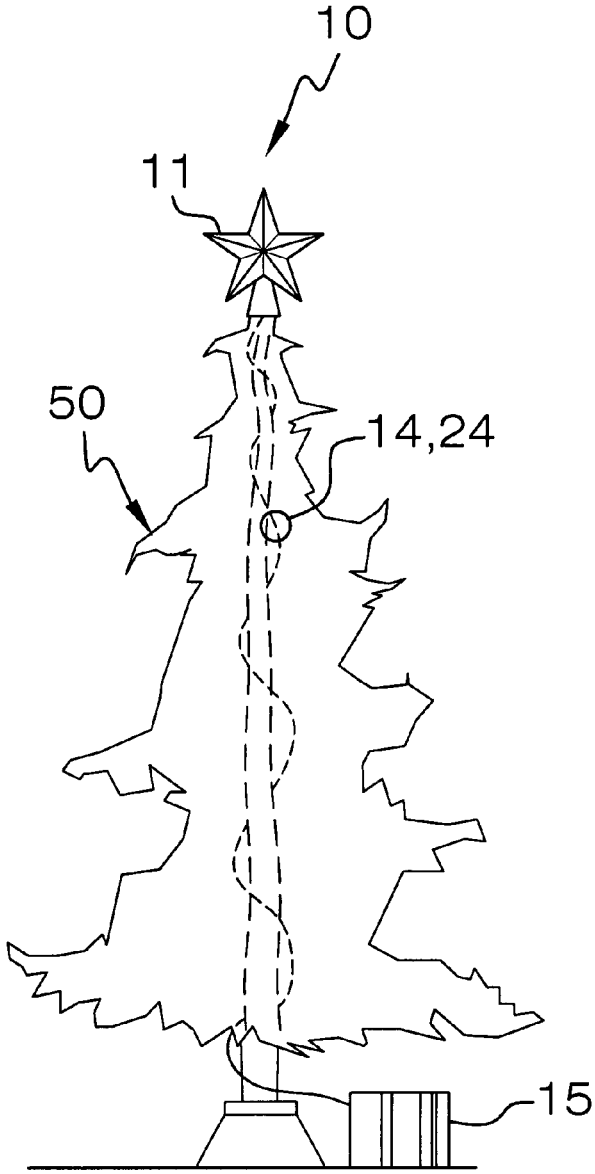
FIG. 1 illustrates an isometric view of the ornament with the smoke and heat sensors shown in hidden lines to portray their respective positions within the ornament.
Figure 3:
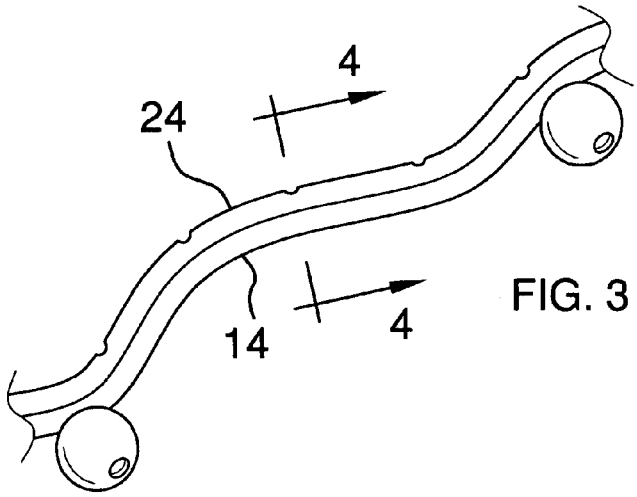
FIG. 3 illustrates a view of the wiring and fire extinguishing line.
Figure 4:
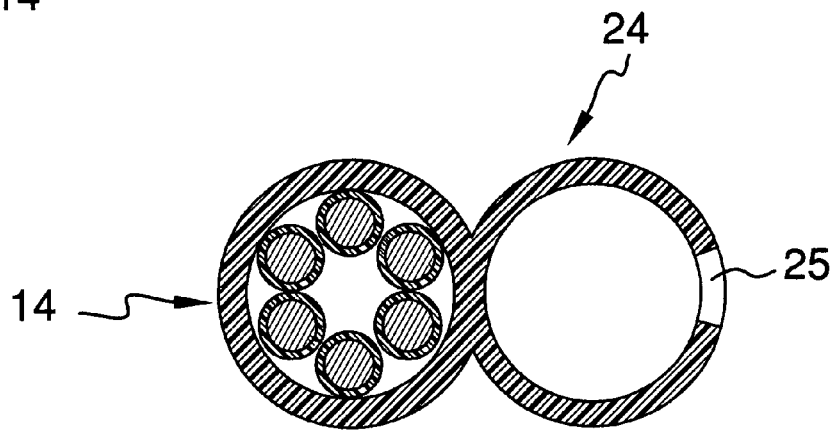
FIG. 4 illustrates a cross-sectional view of the fire extinguishing line as well as the electrical line along line 4-4.
Figure 5:
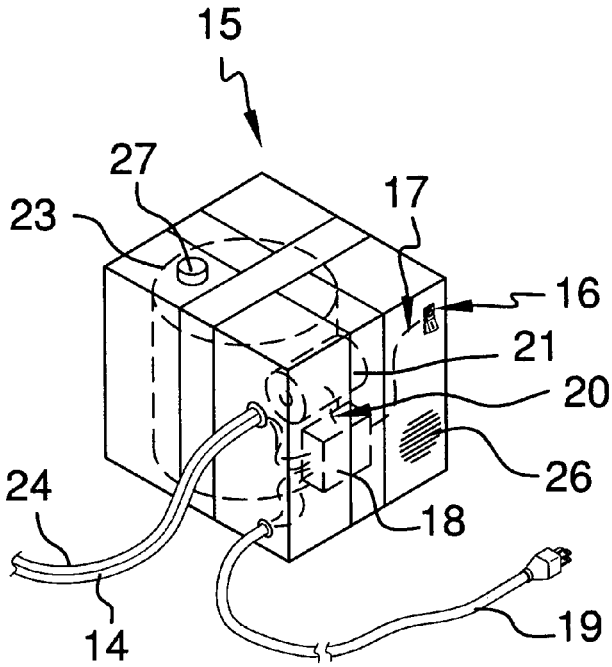
FIG. 5 illustrates an isometric view of the control box with the fire extinguishing fluid reservoir, pump, battery back, wiring, and CPU shown in hidden lines to portray their respective arrangements within the control box.
Figure 6:
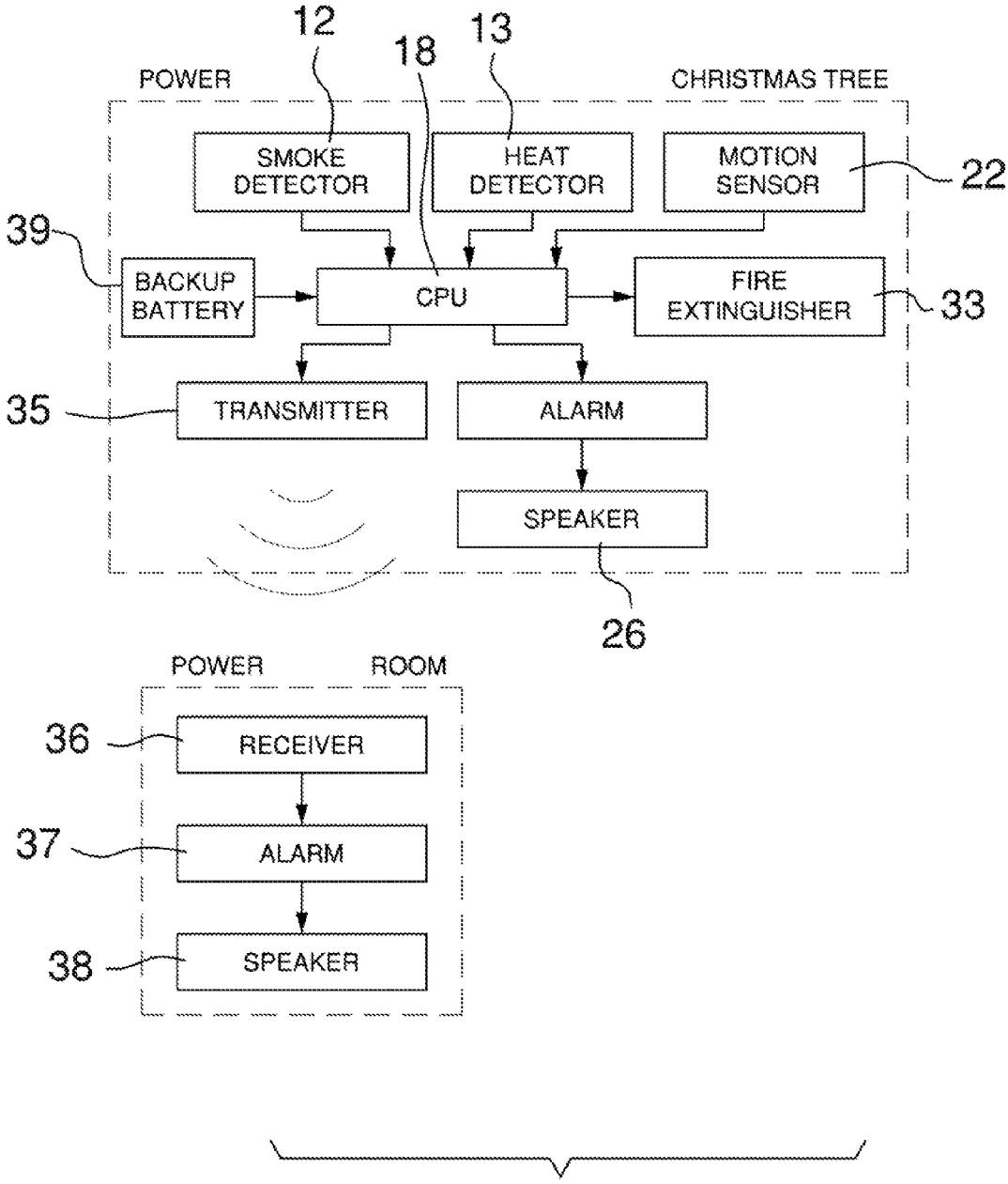
FIG. 6 illustrates a power layout for the various components of the invention.

Detailed reference will now be made to the preferred embodiment of the present invention, examples of which are illustrated in FIGS. 1-6. The invention 10 consists of a Christmas tree ornament 11, wherein contained within the Christmas tree ornament are a smoke detector 12, a heat detector 13, and a motion sensor 22. The heat detector 13 provides heat sensing capabilities that when heat generated from a fire or burning debris will set off the sensor. The motion sensor 22 is designed to act as a burglar alarm that picks up body heat from a person.

Electrical wiring 14 connects the smoke detector 12, the heat detector 13, and the motion sensor 22 to the rest of the invention 10. However, wireless capabilities can be introduced to the smoke detector 12, the heat detector 13, and the motion sensor 22, such that a radio signal is transmitted to the rest of the invention 10. The only additional requirement to make the wireless embodiment feasible is the introduction of a battery supply into the smoke detector 12, the heat detector 13, and the motion sensor 22.

The Christmas tree ornament 11 is typically fitted to the top of a Christmas tree 50. However, the Christmas tree ornament 11 can be designed to resemble any other type of Christmas tree ornament, and can also be hung at any other position on the Christmas tree 50.

The electrical wiring 14 runs from the location of the Christmas tree ornament 11 to a control box 15, which is located on the floor immediately adjacent to the Christmas tree 50. It shall be further asserted that under the wireless embodiment mentioned above, the control box 15 should still be required to be located on the floor immediately adjacent to the Christmas tree 50.

The control box 15 comprises an on/off switch 16 that is securely mounted to a side of the control box 15. Electrical wiring 17 connects to the on/off switch 16 to a central processing unit 18 (hereinafter CPU), which is located inside of the control box 15. A power cord 19 connects to the CPU 18, and provides continuous AC power to the CPU 18. Should the power source provided through the power cord 19 run out, a backup battery supply (not shown) would provide a continuous supply of electrical power to the CPU 18 such that the invention 10 will not unexpectedly turn off.

Electrical wiring 20 runs from the CPU 18 to a pump 21 that when energized will pump water or fire extinguishing fluid (not shown) from the fire extinguishing fluid reservoir 23. The fire extinguishing fluid reservoir 23 is located in the interior of the control box 15. The fire extinguishing fluid reservoir 23 is connected to the pump 21 by a hose (not shown) or the pump 21 is permanently affixed to a predetermined exterior position on the fire extinguishing fluid reservoir 23 so as to eliminate the need for a connecting hose (not shown). It shall be noted for purposes of FIG. 6, that a fire extinguisher system 33 consists of the fire extinguishing reservoir 23, and the pump 21.

When a smoke detector 12 senses smoke, the smoke detector 12 sends a signal either via the electrical wire 14 or via a wireless means (not shown) to the CPU 18. The CPU 18 then processes said signal, and transfers electrical power to the pump 21. Located on the pump 21 is a high pressure outlet (not shown), which is connected to a fire extinguishing hose 24. The fire extinguishing hose 24 has a length that enables it to run up the height of the Christmas tree 50. The fire extinguishing hose 24 also has a plurality of holes 25 that are cut out of the fire extinguishing hose 24 so that when water or fire extinguishing fluid (not shown) travels up the fire extinguishing hose 24 a stream of fire extinguishing fluid is ejected from the fire extinguishing hose 24. The result is a plurality of streams of fire extinguishing fluid (not shown) that encompass every possible area that a fire might burn from the Christmas tree 50.

It is further asserted that the fire extinguishing reservoir 23 holds a volume of water or fire extinguishing fluid (not shown) to last for at least 1 minute of continuous operation of the pump 21 while running at full speed on the backup battery supply (not shown).

Another feature of the control box 15 is a filling cap (not shown), which enables the fire extinguishing reservoir 23 to be filled.

When either the smoke detector 12 senses smoke, or the heat detector 13 senses the movement of heat, or the motion sensor 22 senses body heat, any will send a signal to the CPU 18, which will in turn transmit a signal to a speaker 26. The speaker 26 will generate noise that is comparable to any smoke detector or burglar alarm. In the event of a fire in which the fire extinguishing means provided are not effective or where a thief attempts to disrupt electricity or otherwise silence the alarm, an additional feature of the invention 10 is required. The additional feature of the invention 10 is to continuously run the speaker system for an extended period irregardless of the power cord 19 or the intense heat generated by the fire, which may destroy the smoke detector 12. This added feature provides the end user with peace of mind in knowing that the alarm will continue to sound long after various components of the invention 10 are destroyed or from loss of power provided by the power cord 19 or where the fire extinguishing means prove not effective in putting out the fire.

An additional feature of the invention 10 is to provide a remote alarm system that consists of a transmitter 35 that is electrically wired to the CPU 18. The transmitter 35 sends a radio signal out from the invention 10 to a remote receiver 36, which will activate an alarm system 37 that is broadcasted over a remote speaker 38. The remote receiver 36, alarm system 37, and remote speaker 38 are contained within a housing (not shown) that is separate from the rest of the invention 10 and can be located anywhere within a predetermined range of the transmitter 35. The benefit of the remote alarm system is to provide a more expansive alarm system that can be heard of a greater distance, which may be required for a large home, a home with a guest house, or like residential accommodations.

The invention claimed is:

1. A Christmas tree fire prevention system comprising:

(a) a Christmas tree ornament;

wherein a smoke detector is fitted within an interior of the Christmas tree ornament;

wherein a heat detector for sensing heat generated by a fire in close proximity is fitted within the interior of the Christmas tree ornament;

wherein a motion sensor for sensing body heat is fitted to the Christmas tree ornament;

wherein electrical wiring extends from said Christmas tree ornament to the smoke detector, the heat detector, and the motion sensor;

(b) a control box;

wherein an on/off switch is mounted on an exterior surface of the control box;

wherein the on/off switch is electrically wired to a central processing unit (hereinafter CPU);

wherein a power cord is connected to the CPU and provides continuous AC electrical power from a typical wall outlet;

wherein a backup battery supply is connected to the CPU to provide power in the event that the power supplied by the power cord ceases;

wherein a speaker is electrically wired to the CPU, wherein a radio transmitter is electrically wired to the CPU;

wherein a pump is electrically wired to the CPU;

wherein a fire extinguishing reservoir is connected to the pump by a hose or permanent connection on the surface of the reservoir;

wherein a fire extinguishing hose is connected to the high pressure outlet of the pump;

wherein the fire extinguishing hose has a predetermined length that enables the hose to run up a Christmas tree;

wherein a plurality of holes are cut-out of the hose at predetermined locations;

wherein a filling cap is located on the control box to fill the fire extinguishing reservoir wherein a signal from either the smoke detector or heat detector is transmitted via the electrical wiring down to the CPU, where it is processed, after which a electrical power is transmitted to the pump, which in turn begins pressurizing the fire extinguishing fluid, which travels up the fire extinguishing hose, and is ejected out of the plurality of holes, and throughout the entire tree; furthermore, the CPU simultaneously sends a signal to the speaker, which in turn releases a high-level decibel sound alarm;

wherein the motion sensor sends a first signal to the CPU, which processes said first signal and transmits a second signal to the speaker, which in turn releases said high decibel sound alarm; and wherein either the smoke detector, heat detector, or motion sensor sends said first signal to the CPU, which notifies a remote receiver via said transmitter that generates a remote alarm via a remote speaker.

2. The Christmas tree fire prevention system of claim 1 wherein the Christmas tree ornament resembles a star, angel, or other Christmas tree ornament that typically rests on the top of a Christmas tree.

3. A Christmas tree fire extinguishing means comprising:

(a) a Christmas tree ornament comprising;

(i) a smoke detector;

(ii) a heat detector;

wherein the Christmas tree ornament may be hung at any location on a Christmas tree;

(b) a control box comprising;

a central processing unit (hereinafter CPU);

wherein a power cord is wiredly connected to the CPU;

wherein a speaker is electrically wired to the CPU wherein a radio transmitter is electrically wired to the CPU;

wherein a pump is electrically wired to the CPU;

wherein a fire extinguishing reservoir is connected to the pump;

wherein a fire extinguishing hose is connected to the pump;

wherein the fire extinguishing hose has a predetermined length that enables the hose to run up a Christmas tree;

wherein a plurality of holes are cut-out of the fire extinguishing hose at predetermined locations;

wherein a filling cap is located on the control box to fill a fire extinguishing reservoir; and wherein a signal from either the smoke detector or the heat detector is transmitted via electrical wiring down to the CPU, where it is processed, after which electrical power is transmitted to the pump, which in turn pressurizes the fire extinguishing fluid, which travels up the fire extinguishing hose, and is ejected out of the plurality of holes, and throughout the entire tree; and furthermore, the CPU sounds an alarm via the speaker wherein either the smoke detector or the heat detector signals the CPU; wherein a remote receiver receives a signal from the transmitter via the radio transmitter via the CPU; and wherein the remote receiver sounds an alarm via a remote speaker.

4. The Christmas tree ornament with fire extinguishing means as described in claim 3 wherein a backup battery supply is connected to the CPU to provide power in the event that the power supplied by the power cord ceases.

* * * * *